US006927539B2

(12) United States Patent
Arimoto et al.

(10) Patent No.: US 6,927,539 B2
(45) Date of Patent: Aug. 9, 2005

(54) DEVICE AND METHOD FOR OPERATING A HIGH PRESSURE DISCHARGE LAMP

(75) Inventors: Tomoyoshi Arimoto, Tatsuno (JP); Yoshikazu Suzuki, Yokohama (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/700,570

(22) Filed: Nov. 5, 2003

(65) Prior Publication Data

US 2004/0090184 A1 May 13, 2004

(30) Foreign Application Priority Data

Nov. 8, 2002 (JP) ..... 2002-324780
Aug. 13, 2003 (JP) ..... 2003-292852

(51) Int. Cl.[7] ..... H01J 13/46; H01J 17/04

(52) U.S. Cl. ..... 315/59; 315/56; 313/620; 313/621; 313/622

(58) Field of Search ..... 315/56–59, 46; 313/620–622, 631, 627

(56) References Cited

U.S. PATENT DOCUMENTS 5,109,181 A 4/1992 Fischer et al. ..... 313/571
6,271,628 B1 8/2001 Sugitani et al. ..... 313/637
6,545,430 B2 4/2003 Ono et al. ..... 315/291
2003/0080693 A1 * 5/2003 Ono et al. ..... 315/224
2004/0000880 A1 * 1/2004 Ozasa et al. ..... 315/291

* cited by examiner

*Primary Examiner*—Tuyet Thi Vo
(74) *Attorney, Agent, or Firm*—Nixon Peabody LLP; David S. Safran

(57) ABSTRACT

An ultra-high pressure high pressure discharge lamp device in which the lamp voltage and the distance between the lamp electrodes can be kept stable is achieved by an operating device supplying an alternating current with rectangular waves to the discharge lamp and control is exercised such that a lower boundary value is set and the operating voltage is increased by reducing the operating frequency of the discharge lamp by a given amount, when the operating voltage of the discharge lamp is below the set lower boundary value. Furthermore, control can also be exercised in such a way that an upper boundary value is set and the operating voltage is reduced by increasing the operating frequency of the discharge lamp by a given amount when the operating voltage of the discharge lamp exceeds the set upper boundary value.

15 Claims, 8 Drawing Sheets

DEVICE AND METHOD FOR OPERATING A HIGH PRESSURE DISCHARGE LAMP

BACKGROUND OF THE INVENTION

1. Field of the Invention

The invention relates to a device for operating a high pressure discharge lamp. The invention relates especially to a device for operating a high pressure discharge lamp which comprises an ultra-high pressure discharge lamp of the AC operating type in which an arc tube is filled with greater than or equal to 0.15 mg/mm$^3$ mercury, in which the mercury vapor pressure during operation is greater than or equal to 110 atm, and which is advantageously used as a projection light source of a projection device of the projection type or the like and a device for operating this ultra-high pressure discharge lamp.

2. Description of the Prior Art

In a projector device of the projection type there is a demand for illumination of images onto a rectangular screen in a uniform manner and with adequate color rendition. Therefore, metal halide lamps filled with mercury and a metal halide have been used as the light source. Furthermore, recently smaller and smaller metal halide lamps, and more and more often point light sources, have been produced and lamps with extremely small distances between the electrodes are being used in practice.

Against this background, recently, instead of metal halide lamps, high pressure discharge lamps with an extremely high mercury vapor pressure, for example, with a pressure of at least 200 bar (197 atm), have been used. Here, the broadening of the arc is suppressed by increased mercury vapor pressure, the arc is compressed and a great increase of light intensity is the goal.

Recently, there has been a focus on smaller and smaller projector devices. In the discharge lamp for the above described projector device, on the one hand, there has been a demand for a high light intensity and high degree of maintenance of illuminance. On the other hand, according to the reduction in size of the projector device, there is a demand for smaller and smaller discharge lamps. Therefore, smaller and smaller devices, and smaller and smaller power sources are being used. A reduction in the voltage during starting, in other words, a property to facilitate starting, is expected.

For the above described lamp, for example, an ultra-high pressure discharge lamp is used in which, in a silica glass arc tube, there is a pair of electrodes with a distance of less than or equal to 2 mm opposite and in which this arc tube is filled with greater than or equal to 0.15 mg/mm$^3$ mercury, rare gas and halogen in the range from $1\times10^{-6}$ $\mu$mole/mm$^3$ to $1\times10^{-2}$ $\mu$mole/mm$^3$ (for example, see patent 1 and patent 2 listed below). Furthermore, such a discharge lamp and the operating device for it are disclosed, for example, in patent 3 listed below.

(Patent 1): JP-A HEI 2-148561 (U.S. Pat. No. 5,109,181)

(Patent 2): Japanese patent 2980882 (U.S. Pat. No. 6,271,628)

(Patent 3): JP-A 2001-312997 (U.S. Pat. No. 6,545,430 B2).

In the high pressure discharge lamp disclosed in patent 3, at a mercury vapor pressure within the tube of 15 MPa to 35 MPa in rated operation, the arc tube is filled with a halogen material in the range from $1\times10^{-6}$ $\mu$mole/mm$^3$ to $1\times10^{+2}$ $\mu$mol/mm$^3$. Placing a pair of electrodes within the arc tube and placing a projection part in the vicinity of the middle of the electrode tip area suppress formation of the arc jump phenomenon. An AC voltage is applied by an operating device which comprised of a DC/DC converter, a DC/AC inverter and a high voltage generation device, between the above described pair of electrodes, and thus, operation is carried out.

In such an ultra-high pressure discharge lamp, the phenomenon occurs that projections are formed and grow on the tips of the opposed tungsten electrodes within the arc tube in the course of operation. These projections form and grow dramatically if especially AC operation is carried out with a distance between the electrodes of less than or equal to 1.5 mm, an amount of mercury of at least 0.15 mg/mm$^3$ and an amount of a halogen, such as bromine or the like, from $10^{-6}$ $\mu$mol/mm$^3$ to $10^{-2}$ $\mu$mol/mm$^3$.

The phenomenon that projections are formed on the electrode tips is not always clear. However, the following can be assumed.

In such a discharge lamp, the arc tube is filled with halogen gas. The main objective is to prevent devitrification of the arc tube. The halogen gas also yields the so-called halogen cycle. The tungsten which, during lamp operation, is vaporized from the area with a high temperature in the vicinity of the electrode tip reacts with the halogen and the remaining oxygen which are present within the arc tube, and forms a tungsten compound, such as WBr, $WBr_2$, WO, $WO_2$, $WO_2Br$, $WO_2Br_2$ or the like if, for example, the halogen is Br. These compounds decompose in the area with a high temperature in the gaseous phase in the vicinity of the electrode tip and form tungsten atoms or cations. The tungsten atoms are transported by thermal diffusion (diffusion of the tungsten atoms from the high temperature area in the gaseous phase, i.e., from the arc, in the direction to the low temperature area, i.e., the vicinity of the electrode tip) and in the arc, become cations and during half-cycles when an electrode operates as the cathode are attracted by the electrical field in the direction to the electrode (drift). It can be imagined that, in this way, the density of the tungsten vapor in the gaseous phase in the vicinity of the electrode tip is increased and tungsten is precipitated on the electrode tip, by which projections are formed.

These projections have the effect that they can prevent the arc jump in the sense of fixing the arc hot spot on these projections if they do not grow. But if in the course of continued operation of the lamp the projections grow, the disadvantages arise that the distance between the electrodes is reduced, that the position of the arc radiance spot is changed, that the light intensity is reduced and similar disadvantages.

In patent 3, it is shown that by the formation of the above described projection part the lamp voltage fluctuates (decreases). Furthermore, it is disclosed here that, in the case of a change of the lamp voltage (of the distance between the electrodes) by the formation of the projection part, by controlling the amount of current flowing between the two electrodes, and by switching the first operating frequency to a second frequency, the fluctuation of the lamp voltage is corrected by the formation of the projection part.

For example, with respect to the amount of current flowing between the two above described electrodes the following is shown:

If the lamp voltage (distance between the electrodes) becomes smaller than the normal value, the length of the projection part is reduced by increasing the discharge arc current which flows between the two electrodes, by which the lamp voltage rises. If the lamp voltage (the distance between the electrodes) becomes greater than the normal value, the length of the projection part is increased by the reduction of the discharge arc current.

Based on these ideas, in the operating device described in patent 3, a higher discharge arc current is allowed to flow if the determined lamp voltage is less than the reference voltage. Furthermore, the above described DC/DC converter is controlled with feedback here such that the discharge arc current is reduced when the lamp voltage is higher than the reference voltage. Thus, the fluctuation of the lamp voltage is suppressed.

It can be imagined that control of the change of the distance between the electrodes by the operating frequency, which control is described in the above described patent 3, can be effective in certain cases. However, it was found that the growth of the projections often cannot be advantageously controlled.

In patent 3, the value of the increase or decrease of the determined value of the lamp voltage is determined with respect to the reference voltage (initial value of the lamp voltage during aging operation) and the fluctuation of the distance between the electrodes with feedback is controlled by switching of the two values 150 Hz and 800 Hz.

However, as a result of research by the present inventors, it was found that the growth of projections cannot always be advantageously controlled by this type of control. This publication especially discloses a process for two-stage alteration of the operation frequency. Since in this control the lamp voltage changes rapidly, as can be imagined, stable maintenance of the lamp voltage and of the distance between the electrodes becomes difficult, as can be imagined.

SUMMARY OF THE INVENTION

The present invention was devised to eliminate the above described disadvantages in the prior art.

A principal object of the invention is to devise a device for operating a high pressure discharge lamp in which the lamp voltage and the distance between the electrodes of an ultra-high pressure discharge lamp can be kept stable, in which in a silica glass discharge vessel, there is a pair of opposed electrodes with a distance between them of at most 1.5 mm, the discharge vessel being filled at least 0.15 $mg/mm^3$ of mercury and bromine in the range of from $10^{-6}$ $\mu mol/mm^3$ to $10^{-2}$ $\mu mol/mm^3$.

The above described object is achieved in accordance with preferred embodiments of the invention as follows:

(1) In a high pressure discharge lamp in which the phenomenon occurs that projections are formed on the electrode tips and in which, in a silica glass discharge vessel, there is a pair of opposed electrodes with a distance between them of at most 1.5 mm, the discharge vessel being filled at least 0.15 $mg/mm^3$ of mercury and bromine in the range of from $10^{-6}$ $\mu mol/mm^3$ to $10^{-2}$ $\mu mol/mm^3$, the lower boundary value of the lamp operating voltage is fixed and control is exercised such that the operating voltage is increased by the operating frequency of the discharge lamp being reduced by the frequency which is necessary to suppress the growth of the projections of the electrodes and to lengthen the distance between the electrodes when the operating voltage of the discharge lamp falls below a set lower boundary value.

For example, the operating frequency is reduced by 25 Hz and is fixed at 175 Hz if, for example, the lamp operating voltage falls below 69 V in the case in which the nominal wattage of the discharge lamp is 200 W, the nominal voltage is 70 V, the initial frequency is 200 Hz and the lower boundary value is 69 V. The operating frequency is again reduced by 25 Hz and fixed at 150 Hz if, afterwards, the lamp operating voltage still is below 69 V. This means that the operating frequency continues to be reduced by a given frequency (25 Hz each time) when the voltage is below a lower boundary value.

According to one development of the invention control is exercised as follows:

Together with the lower boundary value, also an upper boundary value of the operating voltage is fixed. If the lower boundary value is not reached, the above described control is exercised. When the upper boundary value is exceeded, the operating frequency of this discharge lamp is increased by a given amount which is necessary for the growth of the projections of the electrodes and for shortening of the distance between the electrodes, and thus, the operating voltage is reduced.

For example, with respect to the lower boundary value, control is exercised in the same manner as described above and moreover the following is done:

In the case in which the lamp operating voltage exceeds the upper boundary value of 71 V, the operating frequency is increased by 25 Hz and is fixed at 225 Hz. Afterwards, the operating frequency is increased again by 25 Hz and it is fixed at 250 Hz if the lamp operating voltage still exceeds 71 V.

As was described above, in the conventional example described in patent 3, by switching the operating frequency to two values (150 Hz and 800 Hz), the voltage is controlled while in the invention, the operating frequency is controlled in several stages in the above described manner. The width of the change of the operating voltage is therefore reduced, and thus, stable operation can be carried out. Furthermore, operation can be carried out according to the individuality of the lamp in an optimum frequency range.

In a high pressure discharge lamp for a projector device which has the above described amount of halogen and the above described amount of mercury, it is empirically determined that the amount of increase or decrease of the frequency should be in the range from 10 Hz to 50 Hz, and more preferably, in the range from 20 Hz to 30 Hz.

(2) In the above described high pressure discharge lamp, the operating voltage of the discharge lamp is determined. When the determined operating voltage of the discharge lamp falls below the above described lower boundary value, during the interval during which this lower boundary value is not reached the growth of the projection of the electrodes is suppressed. In this way, the distance between the electrodes is increased. The operating frequency of this discharge lamp is reduced by a given amount at predetermined time intervals which are necessary for the result to be reflected in the operating voltage. When the operating voltage of the discharge lamp exceeds the above described upper boundary value, during the interval during which this upper boundary value is exceeded, the projections of the electrodes grow, reducing the distance between the electrodes. The operating frequency of this discharge lamp is increased by a given amount at predetermined time intervals which are necessary for the result to be reflected in the operating voltage.

If, for example, the nominal wattage of the discharge lamp is 200 W, the nominal voltage is 70 V, the initial frequency is 200 Hz and the lower boundary value is 69 V, as was described above, the operating frequency is reduced by 25 Hz and fixed at 175 Hz if the lamp operating voltage does not reach 69 V. After a given time (for example, 2 minutes) from the frequency change, if the lamp operating voltage still does not reach 69 V, it is reduced again by 25 Hz.

The operating frequency is controlled by the operating voltage by the change of the frequency after passage of a given time. The operating frequency is changed at any given time from stage to stage, and the operating frequency is changed within a pre-established operating frequency.

In the case of increasing or decreasing the operating frequency, neither the growth nor the growth/reduction of the projections nor a voltage change occurs immediately, but growth/reduction arise after a given time has passed. For this reason, with respect to the increase/decrease of the operation frequency, a time limitation is set. Assuming that there is no time limitation with respect to the increase/decrease of the operation frequency, the increase/decrease of the frequency acts uninterruptedly and the distance between the electrodes is increased/decreased to an excessive degree because the change of the operating voltage occurs slowly.

This is based on the circumstance which is characteristic for the high pressure discharge lamp of the invention, specifically, that the lamp voltage is controlled via the physical phenomenon of the growth/diminution of the projections with feedback. In a high pressure discharge lamp for a projector device which has the above described amount of halogen and the above described amount of mercury, the given time lies empirically in the range from 10 seconds to 240 seconds, and more preferably, in the range from 45 seconds to 180 seconds.

Here, the process for controlling the operating frequency in which only the lower boundary value is fixed and the process for controlling the operating frequency in which not only the lower boundary value, but also the upper boundary value are fixed, was described with respect to the operating voltage of the discharge lamp.

In the former control, control is exercised such that the operating frequency is reduced when the operating voltage falls below a set lower boundary value, and that when this value of the lower boundary is exceeded, it is returned to a given set frequency, for example, 200 Hz. With respect to the increase of the operating voltage, the same control is not exercised.

On the other hand, control is exercised as follows in the latter control:

The operating frequency is reduced when the operating voltage falls below the lower boundary value. Moreover, the operating frequency is not changed when this lower boundary value is exceeded, if the operating voltage exceeds the set upper boundary value, the operating frequency is increased.

If these two controls are compared to one another, in the latter control, the upper boundary value and the lower boundary value of the operating voltage are set. Therefore, with respect to the fluctuation of the operating voltage, more precise control can be carried out.

On the other hand, in the former control, only the lower boundary value of the operating voltage is set. Therefore, with respect to the increase of the operating voltage, precise control is not exercised.

The reason for this is the following:

The discharge lamp is generally subjected to constant power control. There is the disadvantage that, when the operating voltage is reduced, the lamp current increases and the charge on the operation circuit increases. In the case of an increase of the operating voltage, the lamp current decreases and the operating voltage does not increase at least to the feed voltage. The load on the operation circuit does not become very disadvantageous. Precise control with respect to the increase of the operating voltage is not always needed.

Therefore, if only the lower boundary value of the operating voltage is set, the upper boundary of the operating voltage cannot be precisely controlled. However, there is the advantage that the operation circuit and the control device can be simplified.

(3) In operation in which, with respect to the operating voltage of the discharge lamp described above in (1) and (2), not only the lower boundary value, but also the upper boundary value are set, and thus, control is exercised, there is a power supply means which corresponds to the mode for rated operation and the mode for power saving operation. The above described upper boundary value in the mode for power saving operation is set lower than the above described upper boundary value in the mode for rated operation.

The reason why there is a power saving mode is to meet the demand for viewing dark pictures in a projector device and the demand for less working noise of an air-cooling fan, and thus, use with a lower noise level.

If the upper boundary value of the power saving mode is, for example, 61 V, this value is set lower than the upper boundary value of the mode for rated operation (for example, 71 V). By this arrangement, optimum voltage control can be carried out which corresponds to the operating mode with a low illumination.

(4) For (3), a transition is made from the mode for rated operation into the above described power saving mode after the operating voltage of the discharge lamp has decreased to a given value which is lower than the above described lower boundary value in rated operation. This is because, when the mode for rated operation is changed by the immediate reduction of the supply wattage into the power saving mode, the phenomenon occurs that the lamp current is unduly reduced and stable operation cannot be carried out. By the transition from the mode for rated operation into the above described power saving mode in the above described manner, after the operating voltage (distance between the electrodes) of the discharge lamp has also been reduced to a given value in the power saving mode in which the arc can be stably maintained, a stable transition from the mode for rated operation into the above described power saving mode can be carried out. Furthermore, the transition from the mode for rated operation into the above described power saving mode can be carried out after the lamp current has been determined and after the lamp current has increased to greater than or equal to a given value.

(5) In (3), the operating frequency is fixed with respect to the discharge lamp at a value which is greater than the operating frequency in the mode for rated operation. In this way, the operating voltage of the above described discharge lamp is reduced to a given value which is lower than the above described lower boundary value in rated operation.

Here, the property is used that the distance between the electrodes is reduced by the growth of the projections and that the operating voltage is reduced when the operating frequency increases. This accelerates the transition into the power saving mode. The operation frequency, in this case, is greater than the operating frequency in rated operation and is 300 Hz to 500 Hz when the operating frequency in rated operation is fixed, for example, at 200 Hz.

In (5), in the transition from the mode for rated operation into the above described power saving mode, the rated wattage with respect to the above described discharge lamp is immediately fixed at a value which is smaller than the rated wattage in the mode for rated operation. In this way, when switched to the power saving mode, the radiance of the discharge lamp can be immediately reduced.

In (3) to (6), when operation of the above described discharge lamp starts, the mode for rated operation is used to start. This is because of the following:

In the case in which the operating mode in the off state of the above described discharge lamp is the mode for rated operation, the distance between the electrodes is adjusted to the value of the mode for rated operation. In this state, if a low wattage is suddenly supplied according to the power saving mode, the disadvantages arise that the amount of current is reduced and that flicker is formed and similar disadvantages arise.

Action of the Invention

The following effects can be obtained in the invention.

In the high pressure discharge lamp with the above described arrangement, control is exercised in such a way that the lower boundary value of the lamp operating voltage is set and that the operating voltage is increased by reducing the operating frequency of this discharge lamp by a given amount when the operating voltage of the above described discharge lamp falls below a set lower boundary value. This reduces the width of change of the operating voltage and stable operation can be carried out. Furthermore, according to individual lamp differences, operation in the optimum frequency range can be carried out.

Furthermore, because control is exercised in such a way that the upper boundary value of the operating voltage is set and that the operating voltage is reduced by increasing the operating frequency of this discharge lamp by a given amount, even in the case in which the operating voltage of the discharge lamp exceeds the set upper boundary value, the width of the change of the operating voltage is reduced even more and thus stable operation can be carried out. Furthermore, according to the individual lamp differences, operation can be carried out in the optimum frequency range.

In the high pressure discharge lamp with the above described arrangement control is exercised as follows:

During the interval in which the lower boundary value is not reached, the operating frequency of this discharge lamp is reduced at any predetermined time interval by a given amount when the operating voltage of the discharge lamp does not reach this lower boundary value. The operating frequency of the discharge lamp is increased during the interval in which this upper boundary value is exceeded at any predetermined time interval by a given amount when the operating voltage of the discharge lamp exceeds the upper boundary value. The disadvantage of an excess increase/decrease of the distance between the electrodes therefore does not occur and the lamp operating voltage can be stably controlled.

There is a power supply means which corresponds to a mode for rated operation and a power saving mode. The above described upper boundary value in the power saving mode is fixed to be less than the above described upper boundary value in the mode for rated operation. In this way, the radiance of the lamp can be changed if necessary. Furthermore, optimum voltage control can be carried out which corresponds to the mode which has a lower rated wattage.

A transition is made from the mode for rated operation into the above described power saving mode after the operating voltage of the discharge lamp has decreased to a given value which is lower than the above described lower boundary value in rated operation. Thus, a stable transition from the mode for rated operation into the above described power saving mode can be carried out.

Furthermore, by the measure that the operating frequency is fixed with respect to the discharge lamp at a value which is greater than the operating frequency in the mode for rated operation, the operating voltage of the discharge lamp can be reduced to a given value which is lower than the lower boundary value in rated operation.

In the transition from the mode for rated operation into the power saving mode, the rated wattage with respect to the above described discharge lamp is immediately fixed at a value which is smaller than the rated wattage in the mode for rated operation. In this way a rapid transition from the mode for rated operation into the power saving mode can be carried out. When starting operation of the discharge lamp, if the mode for rated operation is used to start, the discharge lamp can be stably started even if the operating mode is the mode for rated operation when the discharge lamp has been turned off beforehand.

The invention is further described below using drawings.

DETAILED DESCRIPTION

Figure 1A:
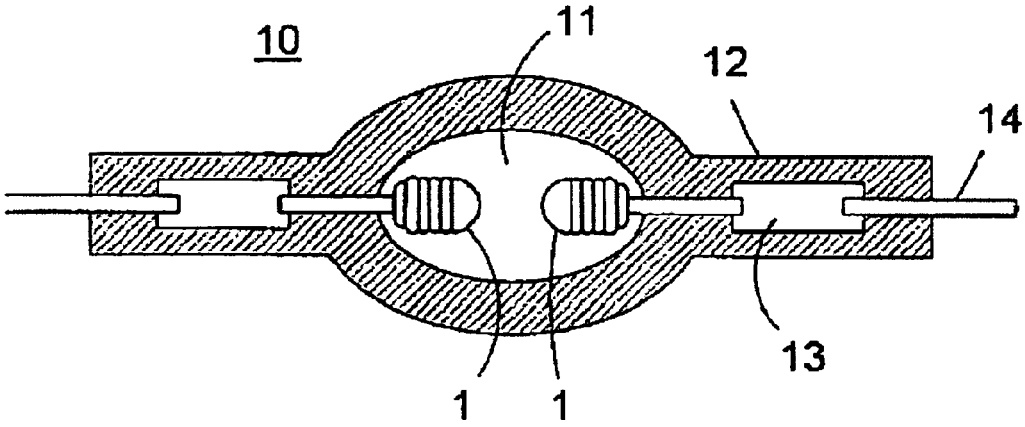
FIGS. 1(*a*) & 1(*b*) each show a schematic of one embodiment of the arrangement of an ultra-high pressure discharge lamp in accordance with the invention.
Figure 1B:
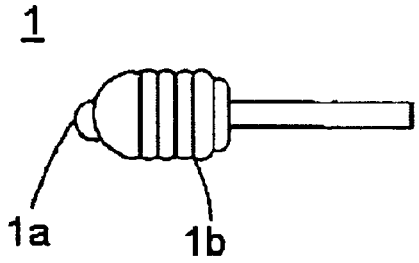

FIG. 1(*a*) shows the overall arrangement of an ultra-high pressure discharge lamp of the AC operating type in accordance with the invention. The discharge lamp 10 has an essentially spherical light emitting part 11 which is formed by a silica glass discharge vessel. In this light emitting part 11, there is a pair of opposed electrodes 1. The hermetically sealed portions 12 are formed such that they extend outward from opposite ends of the light emitting part 11. In each of these hermetically sealed portions 12, a conductive metal foil 13, which normally is made of molybdenum, is hermetically installed, for example, by a shrink seal. The shaft portions of the pair of electrodes 1 are each electrically connected to the metal foil 13 by welding. An outer lead 14 is welded to the other end of the respective metal foil 13 and projects to the outside of the respective sealed portion 12.

The light emitting part 11 is filled with mercury, a rare gas and a halogen gas. The mercury is used to obtain the required wavelength of visible radiation, for example, to obtain radiant light with wavelengths from 360 nm to 780 nm, and is added in an amount of at least 0.15 mg/mm$^3$. With this added amount, during operation, an extremely high vapor pressure that depends on the temperature condition but is at least 150 atm is achieved. By adding a larger amount of mercury, a discharge lamp with a high mercury vapor pressure during operation of at least 200 atm or at least 300 atm can be produced. The higher the mercury vapor pressure, the more suitable the light source which can be implemented for a projector device.

The rare gas contributes to improving the operating starting property, and for example, roughly 13 kPa of argon gas is used as the rare gas.

The halogens can be iodine, bromine, chlorine and the like in the form of a compound with mercury or another metal. The amount of halogen added is selected from the range from $10^{-6}$ $\mu$mol/mm$^3$ to $10^{-2}$ $\mu$mol/mm$^3$. The halogen is intended to prolong the service life using the halogen cycle. For an extremely small discharge lamp with a high internal pressure, as in the discharge lamp of the invention, the main objective of adding this halogen is to prevent devitrification of the discharge vessel.

The numerical values of the discharge lamp are shown by way of example below and are, for example:

the maximum outside diameter of the light emitting part is 9.5 mm;

the distance between the electrodes is 1.5 mm;

the inside volume of the arc tube is 75 mm$^3$;

the nominal voltage is 70 V and the nominal wattage is 200/180 W.

The lamp is operated using an alternating current.

Such a discharge lamp is located in a very small projector device. On the one hand, the overall dimensions of the device are extremely small. On the other hand, there is a demand for a larger amount of light. Therefore, the thermal effect within the arc tube portion is extremely strict. The value of the wall load of the lamp is 0.8 W/mm$^2$ to 2.0 W/mm$^2$, specifically 1.5 W/mm$^2$.

Radiant light with good color rendition can be obtained by such a high mercury vapor pressure and such a high value of the wall load in the case of installation in a presentation apparatus, such as the above described overhead projector or the like.

On the electrode tip, as shown in FIG. 1(*b*), a projection 1*a* is formed. Behind the spherical part of the electrode tip, a coil 1*b* is formed. This coil 1*b* is used for improving the starting property and heat radiation in steady-state operation, but is not essential for the invention.

Figure 2:
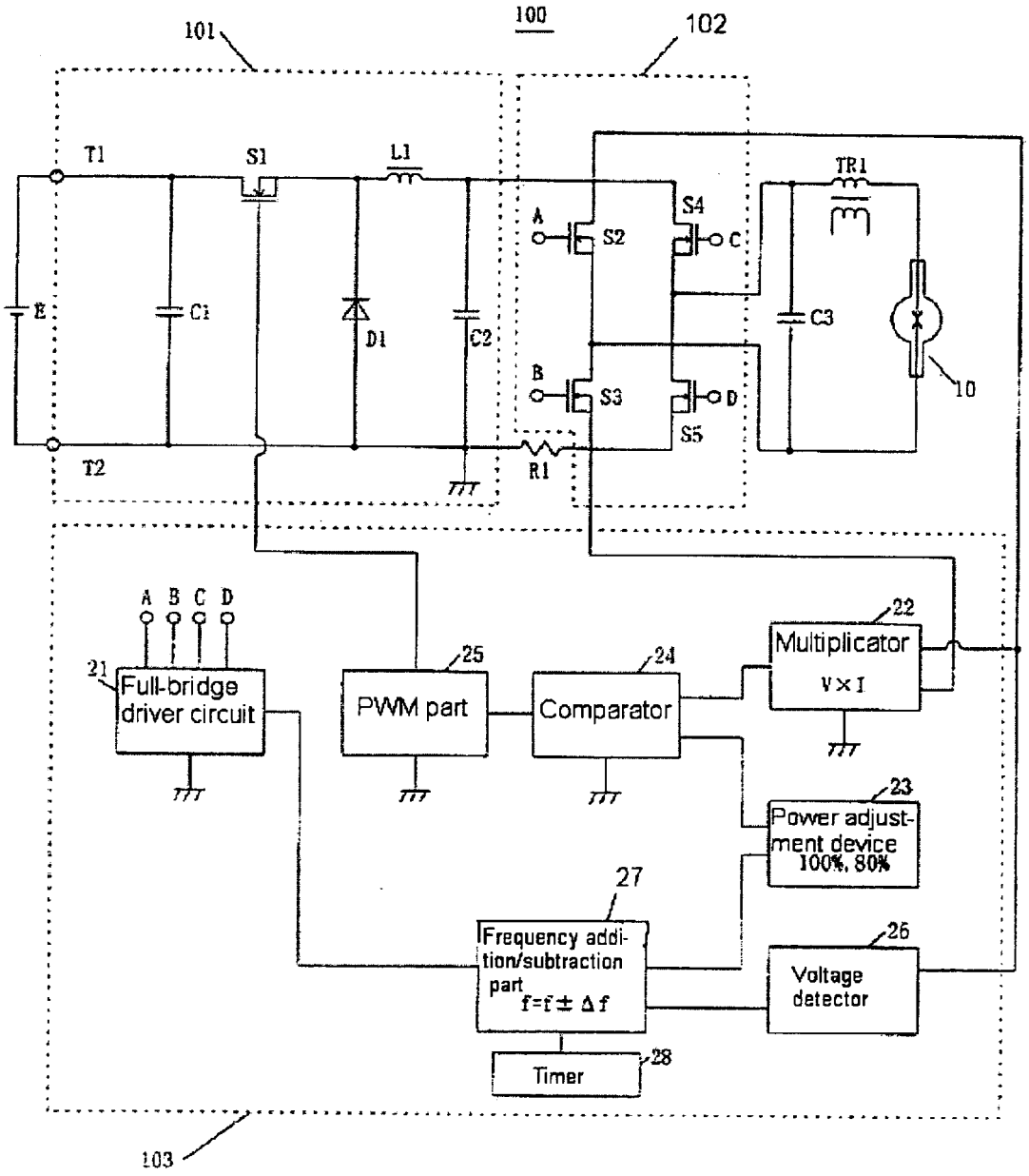
FIG. 2 shows a schematic of one embodiment of the arrangement of an operating device according to the invention.

FIG. 2 shows one embodiment of the arrangement of the operating circuit (feed device) as claimed in the invention. As the control process a case is described in which both the lower boundary value and also the upper boundary value of the operating voltage are set.

In FIG. 2, a operating circuit 100 comprises a switching part 101, a full bridge circuit 102 and a control element 103 which controls the switching part 101 and the full bridge circuit 102. The full bridge circuit 102 comprises switching devices S2 to S5 and converts the DC power of the switching part 101 into AC power with rectangular waves. The switching part 101 controls the wattage by pulse width control of the switching device S1.

A transformer TR1 for an ignitor is series-connected to the discharge lamp 10. A capacitor C3 is series-connected to the discharge lamp 10 and the transformer TR1. AC waves with a rectangular shape are supplied from the full bridge circuit 102 to the series connection of the discharge lamp 10 and the transformer TR1, and thus, the discharge lamp is operated. The circuit comprised of the discharge lamp 10, the transformer TR1 and the capacitor C3, as a whole, is called a "discharge lamp 10" below.

The switching part 101 is comprised of the capacitor C1, the switching device S1 which carries out switching operation by the output of the control element 103, a diode D1, an inductance L1 and a smoothing capacitor C2. The ON/OFF ratio of the switching device S1 is controlled by the PWM (pulse width modulation) part 25 of the control element 103. Via the full-bridge circuit 102, the wattage supplied to the discharge lamp 10 (discharge wattage) is controlled.

To determine the current which is supplied by the switching part 101 to the discharge lamp 10, there is a resistor R1 for determining the current between the switching part 101 and the full-bridge circuit 102. The full-bridge circuit 102 comprises the switching devices S2 to S5 which are formed by a transistor or a FET which are connected like a bridge. The switching devices S2 to S5 are driven by the full bridge driver circuit 22 which is located in the control element 103. The discharge lamp 10 is operated by supplying an AC current with rectangular waves to the discharge lamp 10.

This means that the switching devices S2, S5 and the switching devices S3, S4 are turned on in alternation, AC waves with a rectangular shape are supplied to the discharge lamp 10 in the line path of switching part 101→switching device S2→discharge lamp 10→switching device S5→switching part 101 and in the line path switching part 101→switching device S4→discharge lamp 10→switching device S3→switching part 101, and the discharge lamp 10 is operated.

The control element 103 has the following:

a voltage detector 26 for determining the voltage on the two ends of the capacitor C2 (lamp operating voltage V);

a frequency adder-subtractor 27 which increases or decreases the operating frequency by a given amount according to the lamp operating voltage which is determined by the voltage detector 26;

a timer 28 which sets the time interval for increasing or decreasing the operation frequency; and a full bridge driver circuit 21.

The full bridge driver circuit 21 drives the switching devices S2 to S5 with a frequency which is output by the frequency adder-subtractor 27. Furthermore, the control element 103 has a multiplication device 22 and a wattage setting device 23. The wattage setting device 23 outputs wattage setting signals in the mode for rated operation and wattage setting signals (roughly 80% of the mode for rated operation) in the power saving mode. The multiplication device 22 multiplies the lamp current which has been determined by the resistor R1 for determining the current by the operating voltage and computes the wattage supplied to the discharge lamp 10.

The wattage setting signals of the wattage setting device 23 enable control of the radiance of the discharge lamp 10. Therefore, it is desirable to enable precision setting of the discharge lamp 10 in a range in which it can be stably operated. In the case, for example, in which the nominal wattage of the discharge lamp 10 is 200 W/180 W, as was described above, the adjustment range in the mode for rated operation is roughly 175 W to 220 W. The adjustment range in the power saving mode is roughly 80% of that.

The comparator 24 compares the wattage computed by the multiplication device 22 to the wattage setting signal which is output by the wattage setting device 23. The comparison result is sent to the PWM part 25. The PWM part 25 produces pulse signals with a duty at which the above described wattage and the value of the reference wattage become the same and subjects the switching device S1 to PWM control.

The mode for rated operation and the power saving mode can be switched in a suitable manner by the user. By switching the mode for rated operation into the power saving mode, the wattage setting signal is, for example, 80% of the mode for rated operation. The wattage supplied to the discharge lamp 10 decreases accordingly and the radiance of the discharge lamp 10 is also decreased accordingly.

Using the operating circuit in this embodiment, the wattage supplied to the discharge lamp 10 (discharge wattage) and the operating frequency are controlled in the manner described below. Based on the lamp operating voltage and the voltage between the two ends of the resistor R1 for determining the current, the multiplication device 22 computes the wattage supplied to the discharge lamp 10. A voltage signal which is proportional to the wattage which has been computed by the multiplication device 22 and which is supplied to the discharge lamp 10, and the wattage setting signal in the mode for rated operation or in the power saving mode which is output by the wattage setting device 23 are sent to the comparator 24. The output voltage of the comparator 24 is input into the PWM part 25 which subjects the switching device S1 to pulse width control. The PWM part 25 carries out pulse width control of the switching device S1 such that the output voltage of the comparator 24 reaches zero.

On the other hand, the frequency-adder-subtractor 27 increases or decreases the lamp operating frequency according to the lamp operating voltage which has been determined by the voltage detector 26.

In the case of a constant wattage which is supplied to the discharge lamp 10, if the operating frequency is high, projections grow, the arc length between the electrodes is reduced and the lamp operating voltage is reduced. When the operating frequency is low, the growth of the projection is suppressed, the arc length between the electrodes is increased and the lamp operating voltage is increased.

Therefore, in this embodiment, control is exercised such that the operating voltage is reduced by a given amount Δf (for example, 25 Hz) by increasing the operating frequency of the discharge lamp 10, if the lamp operating voltage exceeds the set upper boundary value (for example, 71 V for rated operation), and that the operating voltage is increased by a given amount Δf (for example, 25 Hz) by decreasing the operating frequency of the discharge lamp, if the lamp operating voltage falls below the set lower boundary value (for example, 69 V for rated operation). It is desirable that the above described upper boundary value is roughly +1 V of the nominal voltage and the lower boundary value is roughly −1 V of the nominal voltage.

If, after a given time Δt (for example two minutes) has passed since the above described frequency has changed, the lamp operating voltage exceeds the above described upper boundary value, the frequency is increased again by the given amount Δf. If the lamp operating voltage falls below the lower boundary value, the frequency is decreased again by the given amount Δf.

Here, the frequency is changed again when after the given time Δt has passed the lamp operating voltage still exceeds the upper boundary value or still is below the lower boundary value. This is because, in the case of an increase/decrease of the frequency, as was described above, neither growth/diminution of the projections of the electrodes nor a change of the lamp operating voltage take place immediately. A certain time is required for the growth/diminution of the projections of the electrodes.

The above described time Δt is called the "standby time" below.

In order to carry out the above described control, the control element 103 in this embodiment is provided with a timer 28 which carries out a time-up with the standby time (for example, two minutes). The frequency-adder-subtractor 27 waits for Δf after the change of the lamp operating frequency until the timer 28 carries out a time-up. When the timer 28 carries out a time-up, and if in doing so the rated lamp operating voltage exceeds the above described upper boundary value or is below the lower boundary value, the frequency adder-subtractor 27 changes the frequency again by Δf. At the lamp operating frequency, the upper boundary value fmax (for example, 400 Hz) and the lower boundary value fmin (for example, 75 Hz) are set beforehand. The lamp operating frequency is controlled within this range. This control adjusts the lamp operating frequency within the range of the upper boundary value fmax and of the lower boundary value fmin to a value which corresponds to the lamp operating voltage. In this way, the lamp operating voltage is stably controlled.

In the power saving mode, as was described above, the output of the wattage setting device 23 and the wattage supplied to the discharge lamp 10 (discharge wattage) is reduced to roughly 80% of rated operation.

In this way, the radiance of the discharge lamp 10 can be reduced less than in the mode for rated operation. For example, in the case of using the discharge lamp 10 in this embodiment, as the light source of a projector device, the demand for darkening of the images, the demand for reducing the working noise of the air cooling fan and a similar demand can be met. If the wattage supplied to the discharge lamp 10 is reduced too much, the arc cannot be stably maintained, but the arc becomes unstable. Therefore, it is desirable for the wattage supplied to the discharge lamp 10 in the power saving mode to be roughly 80% of the mode for rated operation, as was described above. For example, in the case in which the rated wattage of the discharge lamp 10 is 200 W/180 W, the wattage is 160 W/145 W in the power saving mode.

The above described values of the upper boundary and the lower boundary are also reduced accordingly. For example, in the case in which the nominal voltage of the discharge lamp 10 in the mode for rated operation is 70 V (in the case of a nominal voltage in the power saving mode of 60 V), the values of the upper boundary and the lower boundary in the power saving mode are 61 V and 59 V when the value of the upper boundary and lower boundary in the mode for rated operation are 71 V and 69 V, respectively.

Here, if the wattage to be supplied to the discharge lamp 10 is reduced all at once to 80% in order to reach the power saving mode, the lamp current is reduced to an excess degree, by which flicker forms and by which the discharge lamp 10 can no longer be stably operated.

Therefore, in this embodiment, in the transition from the mode for rated operation to the power saving mode, the lamp operating frequency increases to the maximum value fmax and allows the projections of the electrodes to grow, while the wattage supplied to the discharge lamp 10 remains unchanged at the value for rated operation. Only after the lamp operating voltage has been reduced to the given value at which the arc can be maintained even in the power saving mode, the lamp wattage is decreased to 80%.

Furthermore, the transition into the power saving mode can be carried out after the lamp operating frequency has increased to the maximum value, the projections of the electrodes are allowed to grow and when the lamp current has increased to at least a predetermined value.

When switching to the power saving mode during the interval until the lamp operating voltage drops to a given value, if the wattage supplied to the discharge lamp 10 remains unchanged at the value for rated operation, the radiance of the discharge lamp 10 is not immediately reduced. Therefore, there are cases in which the user wrongly assumes that switching to the power saving mode has not taken place or the device has a fault.

Therefore, when switching to the power saving mode, the wattage which is to be supplied to the discharge lamp 10 can be immediately reduced roughly to a value of the operating voltage (arc length) at which the arc can be maintained in the mode for rated operation, and moreover, the lamp operating frequency can be increased to the maximum value fmax. When switching to the power saving mode, this reduces the radiance of the discharge lamp 10 immediately. The above described misunderstandings therefore do not occur.

In the case of switching from the mode for rated operation to the power saving mode as was described above, it is necessary to wait until the lamp operating voltage decreases to a given value and switching takes place afterwards. However, in the case of switching from the power saving mode to the mode for rated operation, the above described disadvantage that the discharge lamp 10 cannot be stably operated does not occur. It is possible to switch to the mode for rated operation immediately.

The reason for this is that, even if at the operating voltage (distance between the electrodes) in the power saving mode of the discharge lamp 10, the wattage is supplied in the mode for rated operation, the disadvantage that the discharge lamp is not stably operated even if the lamp current is increased does not occur.

By carrying out a frequency adjustment in the above described manner, the operating voltage (distance between the electrodes) is gradually adjusted in such a manner that it becomes the operating voltage (distance between the electrodes) in the mode for rated operation.

It is desirable that when operation of the discharge lamp 10 starts the mode for rated operation is always used to start, and not the power saving mode. This is because in the case in which the operating mode is the mode for rated operation in shutting off beforehand, the distance between the electrodes (operating voltage) is the distance between the electrodes in the mode for rated operation and because flicker occurs as was described above when in this state the power saving mode is used to start, and because the discharge lamp 10 cannot be stably operated.

In FIG. 2, control by the multiplication device 22, the wattage setting device 23, the comparator 24, the frequency adder-subtractor 27, the timer 28 and the like can also be exercised by software by a processor. A flow chart in the case of carrying out the above described control using software is described below.

Figure 3:
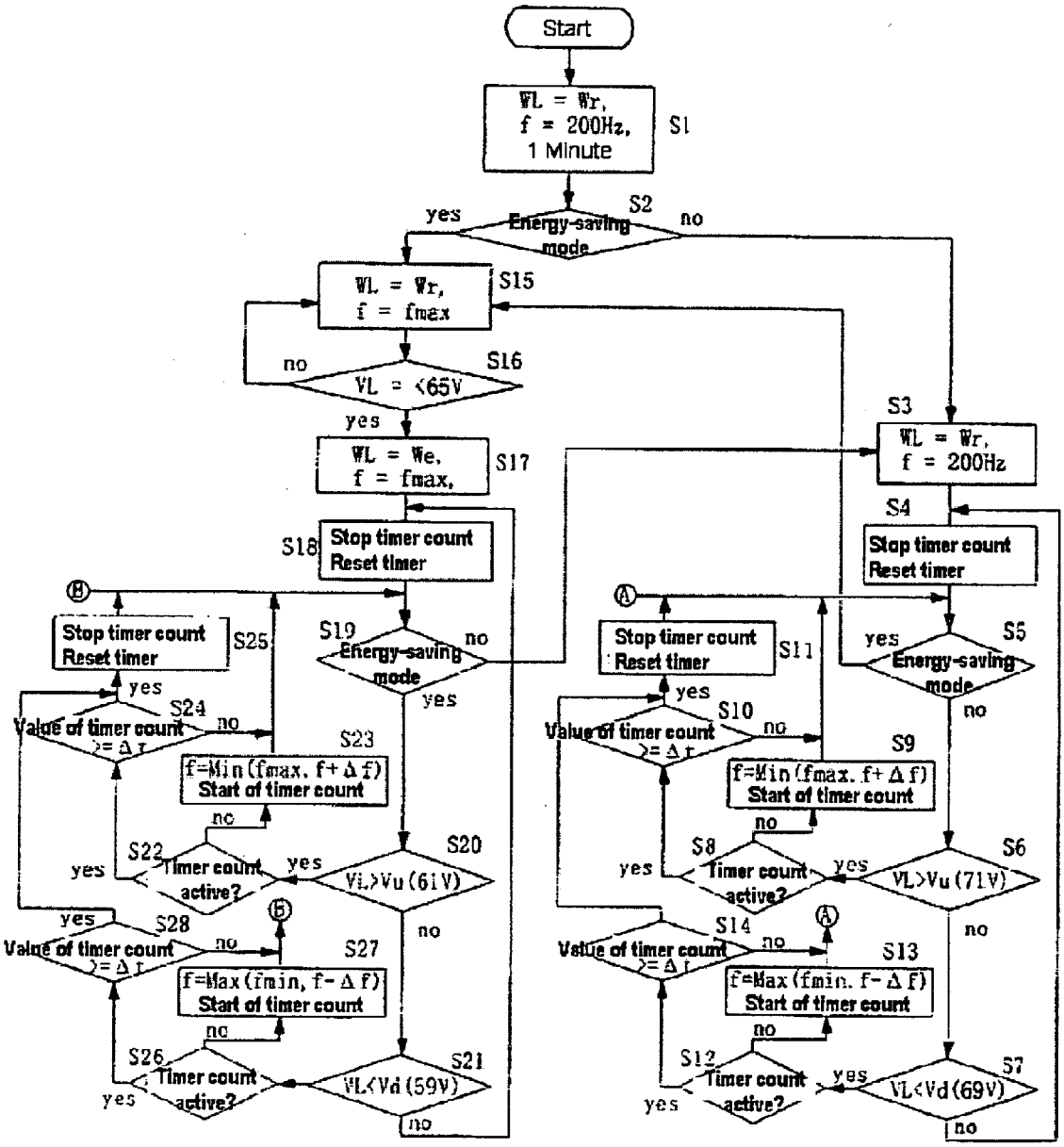
FIG. 3 is a flow chart of one embodiment of operating frequency setting of the invention.

FIG. 3 is a flow chart which describes the operation of the frequency adder-subtractor 27, of the timer 28 and the like which are shown in FIG. 2. Using FIG. 3, control of the lamp operating frequency in this embodiment is described. In the figure, the reference letters label the following:

| | |
|---|---|
| Wr: | nominal wattage of the discharge lamp (200 W/180 W) |
| Wc: | wattage of the discharge lamp in the power saving mode (160 W/145 W) |
| Vr: | nominal lamp voltage (at the nominal wattage: 70 V, at the economical wattage: 60 V) |
| Vu: | upper boundary value of voltage control (Vr + 1 V) |
| Vd: | lower boundary value of voltage control (Vr − 1 V) |
| Δt: | standby time (for example 2 minutes) |
| f: | operating frequency (Hz) |
| fmax: | upper boundary value of the operating frequency (400 Hz) |
| fmin: | lower boundary value of the operating frequency (75 Hz) |
| Δf: | width of the renewal of the operating frequency (25 Hz) |
| WL: | lamp wattage (W) |
| VL: | lamp voltage (V) |

When starting the discharge lamp 10, full power (lamp wattage WL=nominal wattage Wr) is supplied and at an operating frequency f of 200 Hz one minute operation is carried out (step S1 in FIG. 3). Then, in step S2 it is assessed whether there is a power saving signal or not, which indicates power saving operation. When the power saving signal is not present, step S3 follows. When the power saving signal is present, step S15 follows. As was described above, when starting operation of the discharge lamp 10, the step S2 is not needed if the mode for rated operation is always used to begin. In this case, there is a passage from step S1 to S3. If the power saving signal is not present, in step S3, the lamp wattage WL is set to the nominal wattage Wr. Then, at step S4, the timer count stops, and the timer numerical value is reset, when the timer, which is counting whether the standby time is there or not, is counting. In step S5, it is assessed whether there is a power saving signal or not. If not, in step S6, it is assessed whether the lamp voltage VL is greater than the upper boundary value Vu of voltage control (the upper boundary value of voltage control in rated operation: 71 V). When VL>Vu, there is passage to step S8 and the operating frequency is adjusted. When VL is not greater than Vu, step S7 follows.

In step S8, it is assessed whether the timer is counting. If not, at step S9, the timer count starts, moreover, computation of f=Min (fmax, f+Δf) is performed and the operating frequency f is changed. This means that, in the case in which f+Δf exceeds the upper boundary fmax of the operating frequency, when the operating frequency is designated f+Δf, the operating frequency is limited to fmax. Then, there is a return to step S5.

After changing the frequency in the above described manner, in step S6, the lamp voltage VL is compared to the upper boundary value Vu of the voltage control. When VL>Vu, step S8 follows. Since timer counting takes place this time, there is a transition from step S8 to step S10. When the value of the timer count is less than the standby time Δt, there is a return to step S5 and the above described treatment is repeated.

If the above described treatment is repeated and if the timer counting value reaches the standby time Δt, step S10 is followed by step S11, timing stops, the timer counting value is reset and there is a return to step S5. In step S6, it is assessed whether VL>Vu. If VL is still greater than Vu, step S8 follows, the frequency changes again by Δf and the above described treatment is repeated. If, in step S6, it is assessed as VL≦Vu, step S6 is followed by step S7 and it is assessed whether VL<Vd, as is described below.

That is, as was described above, after the change of the lamp operating frequency by Δf, it is necessary to wait until the standby time Δt has passed. If as Δt is passing the lamp operating voltage exceeds the above described upper boundary value Vu, the frequency changes again by Δf. If as Δt is passing the lamp operating voltage does not reach the above described upper boundary value Vu, step S7 follows.

In steps S7 to S14, the above described treatment is carried out with respect to the lower boundary value. In step S7, it is assessed whether the lamp voltage VL is greater than the lower boundary value Vd of voltage control (lower boundary value of voltage control in rated operation: 69 V). If VL<Vd, step S12 follows. If Vd is not greater than VL, there is a return to step S4.

In step S12, it is assessed whether the timer is counting. If the timer is not counting, timer counting is started at step S13, and moreover, computation of f=Max (fmin, f−Δf) is carried out and the operating frequency f is changed. That is, in the case in which f−Δf falls below the lower boundary fmin of the operating frequency, where the operating frequency is designated f−Δf, the operating frequency is limited to fmin. Then, there is a return to step S5.

After the frequency changes in the above described manner, in step S7, the lamp voltage VL is compared to the lower boundary value Vd of voltage control. If VL<Vd, step S12 follows. Since the timer is counting this time, step S12 is followed by step S14. If the value of the timer count is less than the standby time Δt, there is a return to step S5 and the above described treatment is repeated.

When the above described treatment is repeated and when the timer counting value reaches the standby time Δt, step S14 is followed by step S11, timing is stopped, the timer counting value is reset and step S5 returns. In step S6, it is assessed whether VL<Vu. If VL is still less than Vu, step S8 follows, the frequency is changed again by Δf and the above described treatment is repeated. If, in step S7, it is assessed as Vd≦VL, step S7 is followed by step S4 and it is assessed whether VL<Vd, as is described below.

That is, as was described above, after the change of the lamp operating frequency f by Δf, it is necessary to wait until the standby time Δt has passed. If as Δt is passing the lamp operating voltage does not reach the above described lower boundary value Vd, the frequency changes again by Δf. If as Δt is passing the lamp operating voltage does not fall below the above described lower boundary value Vd, step S4 follows.

If during the implementation of the above described control, the power saving signal is input, step S15 follows. In steps S15 to S16, the lamp wattage WL is set to the nominal wattage Wr, the operating frequency f is fixed at fmax and the lamp voltage VL reaching less than or equal to 65 V is awaited.

When the lamp voltage VL reaches less than or equal to 65 V, in step S17 the lamp wattage WL is set to the wattage We in the power saving mode. Then, in step S18, the timer count is stopped and the timer value is reset if the timer is still counting whether the standby time is there or not.

Then, in step S19, it is assessed whether the power saving signal has been input or not. If the power saving signal has been input, the treatment of steps S20 to S25 is carried out.

The treatment of steps S20 to S25, besides the aspect that the upper boundary value Vu has been changed to 61 V as the upper limit of the voltage control in power saving operation and the lower boundary value Vd has been changed to 59 V as the lower limit of voltage control in power saving operation, is identical to the treatment of steps S6 to S14. As was described above, it is assessed whether the lamp operating voltage exceeds the upper boundary value Vu in power saving operation or falls below the lower boundary value Vd or not. If the lamp operating voltage exceeds this upper boundary value Vu or falls below the lower boundary value Vd, the lamp operating frequency f is changed by Δf and it is awaited until the standby time Δt passes. As Δt is passing, it is assessed whether the lamp operating voltage exceeds or falls below the upper boundary value Vu in the above described power saving operation and exceeds or falls below the lower boundary value Vd. For exceeding or falling below, the frequency is changed again by Δf. If, in turn, Δt has passed, step S18 returns and the above described treatment is repeated if the lamp operating voltage does not exceed the above described upper boundary value Vu or does not fall below the lower boundary value Vd.

Figure 4:
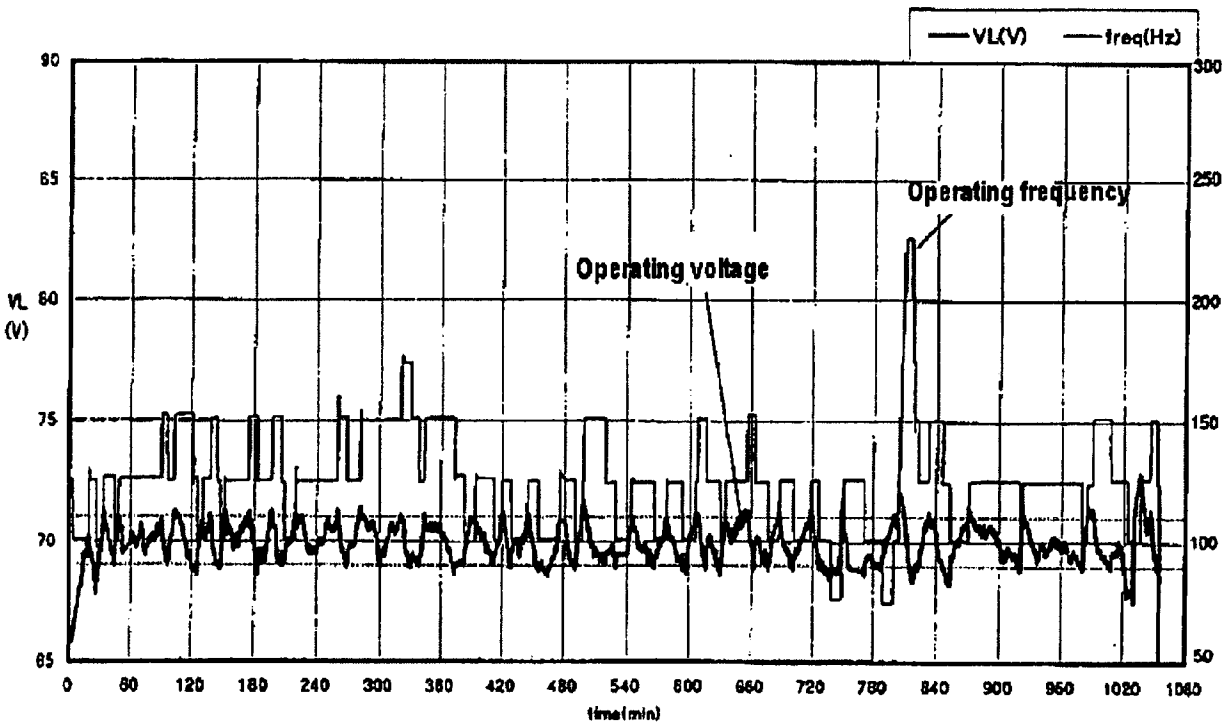
FIG. 4 is a plot of the changes of the operating voltage and the operating frequency as function of time.

FIG. 4 shows the changes of the lamp voltage and the operating frequency when the discharge lamp 10 starts with the mode for rated operation (lamp wattage 180 W) and when the above described frequency setting is carried out. In FIG. 4, the x axis plots the time (minutes) and the y axis plots the lamp operating voltage VL (V) and the operating frequency f (Hz). The bolded line shows the lamp operating voltage VL and the thinner line shows the operating frequency f. Here, a case is shown in which the discharge lamp 10 has been started in the mode for rated operation. The above described upper boundary value is 71 V and the above described lower boundary value is 69 V.

As is shown in FIG. 4, in this embodiment, the lamp operating voltage VL was controlled essentially within a given range and the discharge lamp 10 was stably operated.

Figure 5:
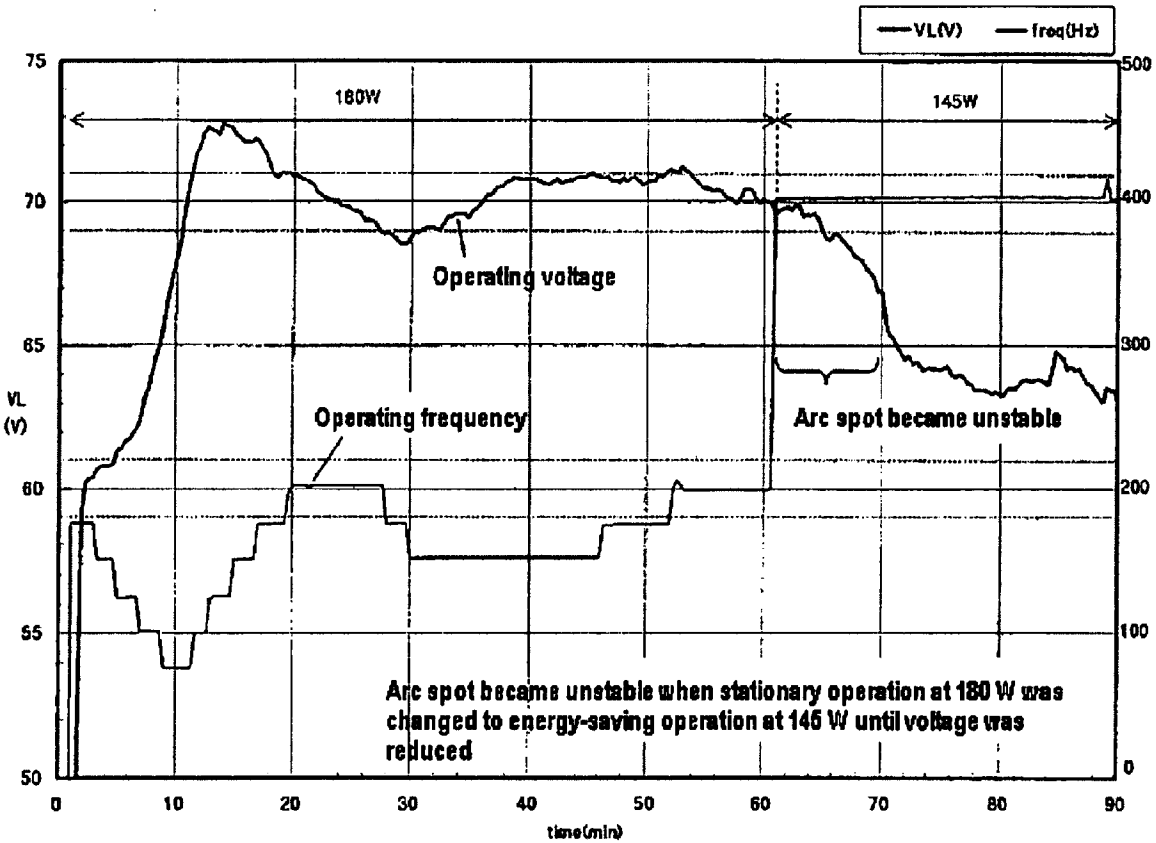
FIG. 5 is a plot of the changes of the operating voltage and the operating frequency as a function of time in the case of direct switching from rated operation into the power saving mode (negative example)

FIG. 5 shows the changes of the lamp voltage and the operating frequency in the case of direct switching of the mode for rated operation to the power saving mode with 145 W, without waiting until the lamp operating voltage drops to the given value (65 V). In FIG. 5, the x-axis plots the time (minutes) and the y axis plots the lamp operating voltage VL (V) and the operating frequency f(Hz). The bolded line shows the lamp operating voltage VL and the thinner line shows the operating frequency f. In this case, the arc spot moved when the lamp wattage was switched to 145 W and it became unstable until the lamp operating voltage diminished.

Figure 6:
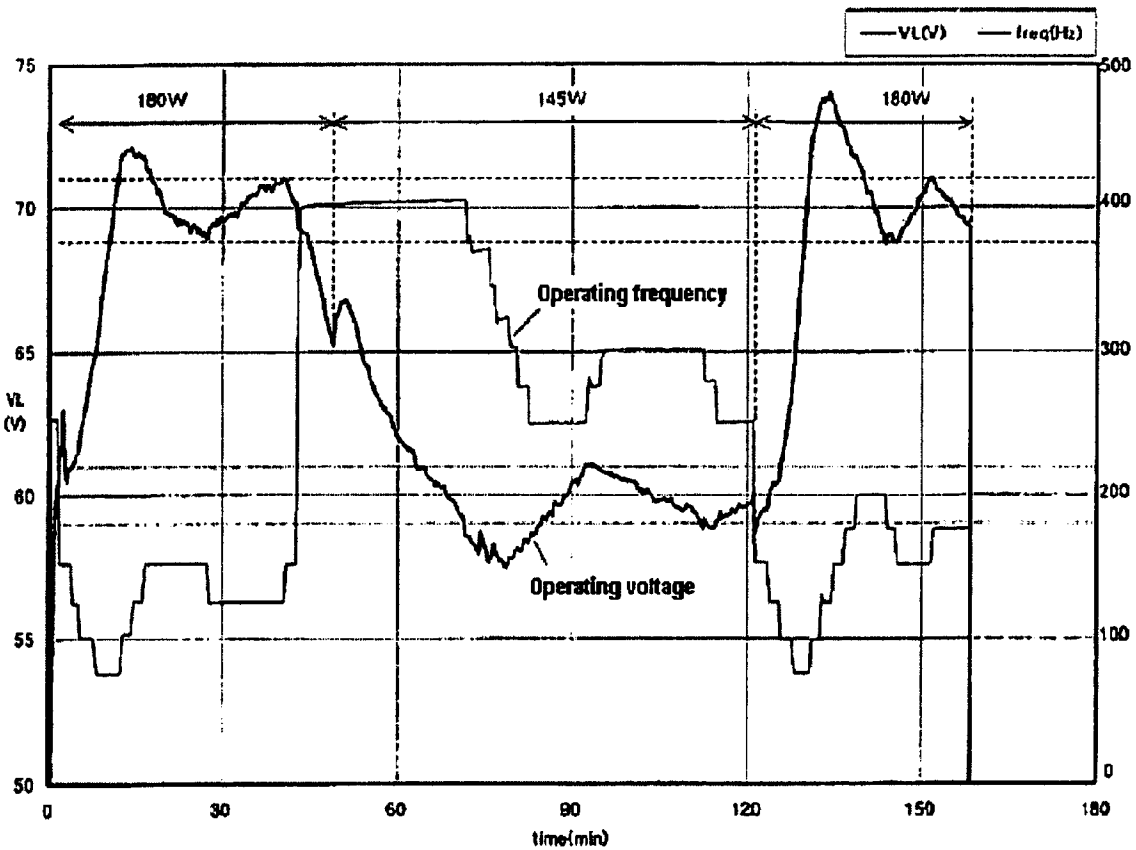
FIG. 6 is a plot of the changes of the operating voltage and the operating frequency as a function of time in the case of a reduction of the operating voltage in operation with 180 W and 400 Hz before direct switching from rated operation into the power saving mode.

FIG. 6 shows the changes of the lamp voltage and the operating frequency in the case of switching from the mode for rated operation to the power saving mode while keeping the lamp wattage constant at 180 W. As shown, the operating frequency increased to fmax (400 Hz), the distance between the electrodes was reduced and afterwards the lamp wattage was reduced to 145 W. As in FIG. 5, the x-axis plots the time (minutes) and the y axis plots the lamp operating voltage VL (V) and the operating frequency f(Hz) here too. The bolded line shows the lamp operating voltage VL and the thinner line shows the operating frequency f. In this case, the motion of the arc spot VL which is shown in FIG. 5 never occurred. Stable switching to the power saving mode was carried out.

Figure 7:
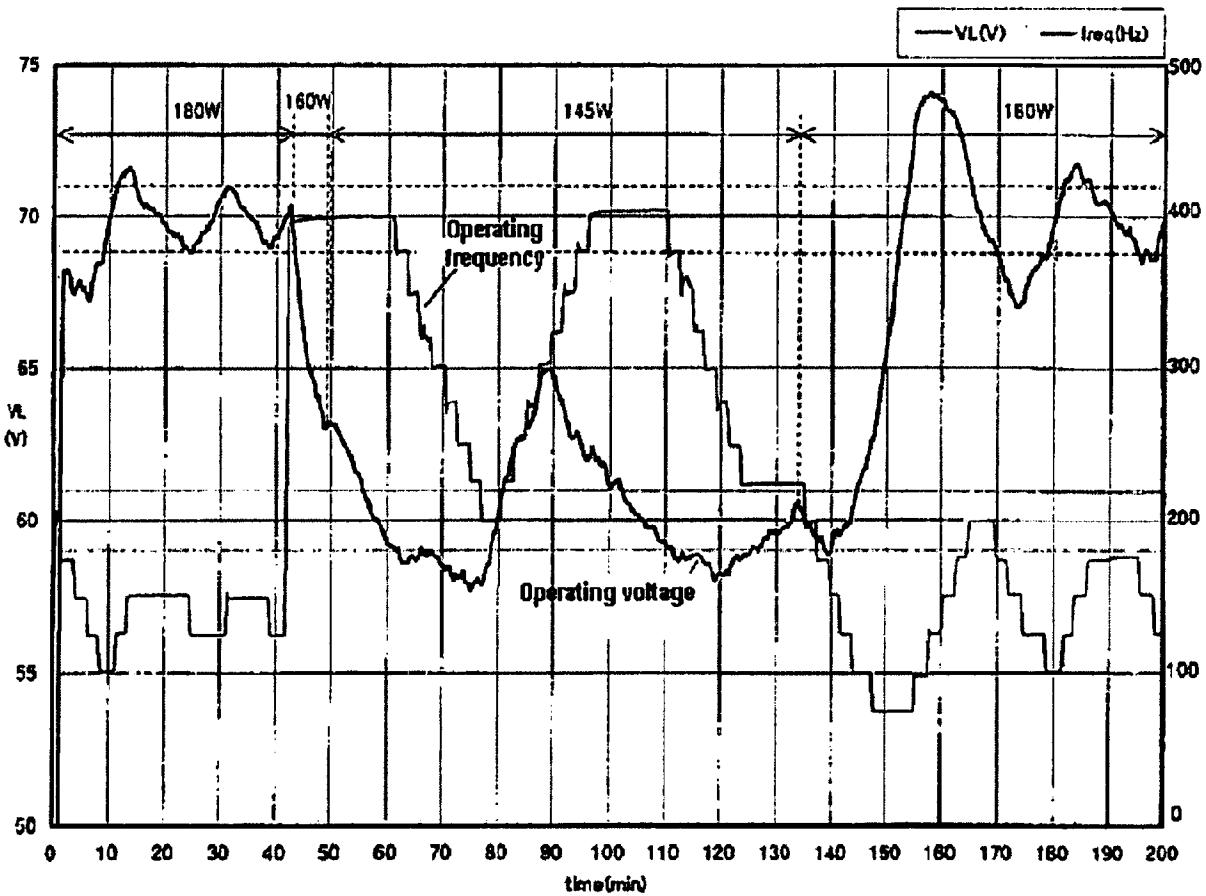
FIG. 7 is a graph showing the changes of the operating voltage and the operating frequency as a function of time in the case of a reduction of the operating voltage in operation with 160 W and 400 Hz with direct switching from rated operation into the power saving mode.

FIG. 7 shows the changes of the lamp voltage and the operating frequency in the case in which, when switching from the mode for rated operation to the power saving mode, the lamp wattage has been switched to 160 W and in which, moreover, the operating frequency is increased to fmax (400 Hz), the distance between the electrodes has been reduced, and afterwards, the lamp wattage has been reduced to 145 W. As in FIG. 5, the x axis plots the time (minutes) and the y axis plots the lamp operating voltage VL (V) and the operating frequency f (Hz). The bolded line shows the lamp operating voltage VL and the thinner line shows the operating frequency f.

In this case, as in FIG. 6, the motion of the arc spot shown in FIG. 5 never occurred either. Stable switching to the power saving mode was carried out.

In the above described embodiment, with respect to the nominal voltage (70 V) the values of the upper boundary (71 V) and lower boundary (69 V) which differ from one another were fixed. However, it is also possible to set the same values (for example, 70 V) of the upper boundary and the lower boundary and always continue control.

A operating circuit can also be used in which only the lower boundary value of the operating voltage is set and in which only in the case in which the lamp operating voltage falls below this lower boundary value is the operating frequency of the discharge lamp reduced by a given amount Δf, and thus, the operating voltage is increased. In this case, the upper boundary value of the operating voltage is not set.

For example, control is exercised such that, in the case of a rated operating voltage of 70 V, a lower boundary value of 69 is set and that the operating frequency of the discharge lamp is reduced by a given amount Δf (for example, 25 Hz) when the lamp operating voltage 69 V is not reached. If, after a given time Δt (for example two minutes) has passed since the change of the above described frequency, the lamp operating voltage is below the above described lower boundary value, the frequency is reduced again by the given amount Δt.

If, during the reduction of the operating frequency, the lamp operating voltage exceeds the lower boundary value of 69 V, the operating frequency at this time is returned to a set reference frequency (for example, 200 Hz). In this case, the upper boundary value of the operating voltage of 71 V in the above described embodiment is not set. The control in which the operating frequency is increased according to the increase of the operating voltage is therefore not exercised. It is desirable for the lower boundary value to be roughly −1 V of the nominal operating voltage.

Figure 8:
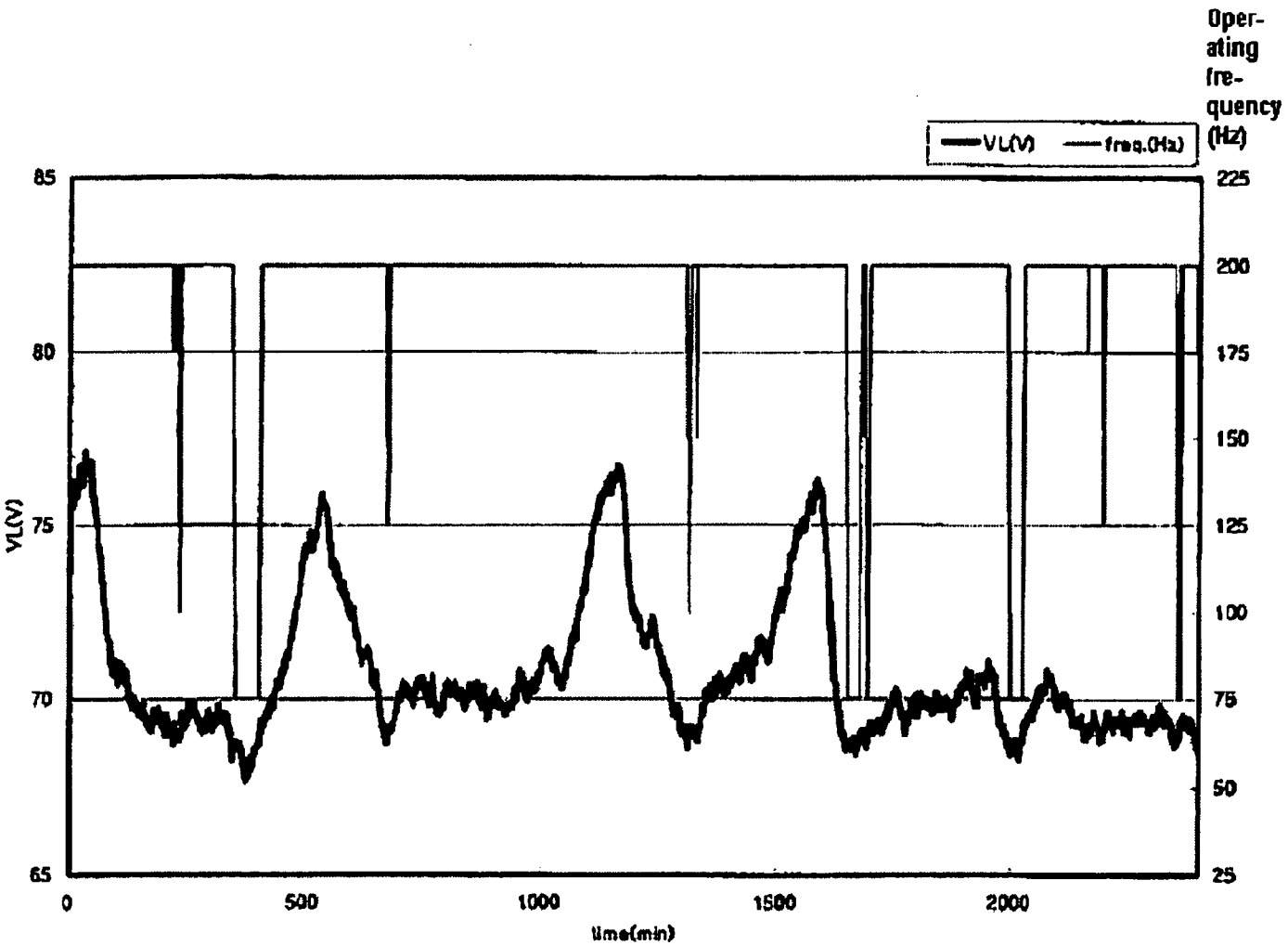
FIG. 8 is a graph of the changes of the operating voltage and the operating frequency as a function of time when operating control of the discharge lamp is performed by setting only the lower boundary value.

FIG. 8 shows the changes of the lamp voltage and the operating frequency when starting the discharge lamp 10 in the rated operation mode (lamp wattage 180 W) and in the execution of the above described frequency setting. In FIG. 8, the x axis plots the time (minutes) and the y axis plots the lamp operating voltage VL (V) and the operating frequency f (Hz). The bolded line shows the lamp operating voltage VL and the thinner line shows the operating frequency f. Here, a case is shown in which the discharge lamp 10 is being started in the mode for rated operation. The given frequency is 200 Hz and the lower boundary value is 69 V. As is shown in FIG. 8, according to this embodiment, the lamp operating voltage VL is prevented from falling below the lower boundary value of 69 V of voltage control to a significant degree. The discharge lamp 10 can thus be stably operated.

It is desirable for the rectangular waveform of the lamp current to be a waveform which contains overshoots and/or preshoots. Especially in the case of operation with the power saving mode according to the reduction of the lamp current, an arc jump is formed more frequently, resulting in cases in which so-called flicker is formed in images. The above described measure is therefore conversely desired as the measure.

Specifically, by partially changing the power constant, the essentially rectangular current waveform is made into a waveform which contains overshoots and preshoots. In this way, due to the high instantaneous current, the tip area of the projections of the electrode tips are shifted in the molten state, at least when the electrodes execute anode operation. As a result, the tip of the projection part can maintain a smooth shape without concave and convex parts. In this way, formation of the arc jump can be prevented. Besides operation with the power saving mode, the action is the same for the same reason when the value of the lamp current becomes low.

As an example of numerical values, a current waveform which contains overshoots and preshoots with the crest factor in the range from 1.1 to 2.5 is desirable. This means that the height of the overshoot or preshoot with respect to the top line of the rectangular waveform is 1.1 to 2.5.

Here, the term "overshoot" is defined as a distortion which follows the main transition and which arises in the form in which the waveform sways in the same direction as the main transition, i.e., a peak when rising for a rectangular current waveform. Furthermore, the term "preshoot" is defmed as a distortion which arises immediately before the main transition in the form in which the waveform sways in the opposite direction to the main transition, i.e., a peak which arises proximately before descending of the rectangular current waveform.

We claim:

1. Lamp Device for operating a high pressure discharge lamp, comprising:

an ultra-high pressure discharge lamp having a silica glass discharge vessel in which there is a pair of opposed electrodes at a distance from each other of at most 1.5 mm, at least 0.15 mg/mm$^3$ of mercury and bromine in a range of $10^{-6}$ $\mu$mol/mm$^{-2}$ to $10^{-2}$ $\mu$mol/mm$^3$; and a feed device which supplies an alternating current with rectangular waves to the discharge lamp and thus operates the discharge lamp, wherein the feed device is operative for controlling the discharge lamp such that the operating voltage is increased by reducing the operating frequency of the discharge lamp by a given amount when the operating voltage of the above described discharge lamp falls below a set lower boundary value, and wherein the feed device is also operative for controlling the discharge lamp such that the operating voltage is reduced by increasing the operating frequency of the discharge lamp by a given amount when the operating voltage of the above described discharge lamp exceeds a set upper boundary value.

2. Device for operating a high pressure discharge lamp as claimed in claim 1, wherein the feed device is also operative for controlling the discharge lamp such that the operating voltage of the discharge lamp is determined, wherein, during an interval in which the lower boundary value is not reached, the operating frequency of the discharge lamp is reduced by said given amount at any predetermined time interval when the determined operating voltage of the discharge lamp is below the lower boundary value, and wherein, during an interval in which the above described upper boundary value is exceeded, the operating frequency of the discharge lamp is increased by said given amount at any predetermined time interval when the operating voltage of the above described discharge lamp exceeds this upper boundary value.

3. Device for operating a high pressure discharge lamp as claimed in claim 1, wherein the feed device has a power supply means for producing a rated operation mode and a power saving operation mode, and wherein the upper boundary value in the power saving operation mode is set lower than the upper boundary value in the rated operation mode.

4. Device for operating a high pressure discharge lamp as claimed in claim 3, wherein the feed device is operative for always commencing operation of the discharge lamp in the rated operation mode.

5. Device for operating a high pressure discharge lamp as claimed in claim 3, wherein the feed device is operative for enabling a transition from the rated operation mode into the power saving operation mode only after the operating voltage of the discharge lamp has decreased to a given value which is lower than the lower boundary value in rated operation mode.

6. Device for operating a high pressure discharge lamp as claimed in claim 5, wherein the feed device is operative for reducing the operating voltage of the discharge lamp to a given value which is lower than the lower boundary value in the rated operation mode by fixing the operating frequency at a value which is greater than the operating frequency in the rated operation mode.

7. Device for operating a high pressure discharge lamp as claimed in claim 6, wherein the feed device is operative in a transition from the rated operation mode into the power saving mode for immediately fixing the rated wattage at a value which is smaller than the rated wattage in the rated operation mode.

8. Device for operating a high pressure discharge lamp as claimed in claim 6, wherein the feed device is operative for always commencing operation of the discharge lamp in the rated operation mode.

9. Method of operating a high pressure discharge lamp having a silica glass discharge vessel in which there is a pair of opposed electrodes at a distance from each other of at most 1.5 mm, at least 0.15 $mg/mm^3$ of mercury and bromine in a range of $10^{-6}$ $\mu mol/mm^3$ to $10^{-2}$ $\mu mol/mm^3$ using a feed device which supplies an alternating current with rectangular waves to the discharge lamp, comprising the steps of:

using the feed device for controlling the discharge lamp such that the operating voltage is increased by reducing the operating frequency of the discharge lamp by a given amount when the operating voltage of the above described discharge lamp falls below a set lower boundary value; and wherein the feed device controls the discharge lamp such that the operating voltage is reduced by increasing the operating frequency of the discharge lamp by a given amount when the operating voltage of the above described discharge lamp exceeds a set upper boundary value.

10. Method of operating a high pressure discharge lamp as claimed in claim 9, wherein the feed device controls the discharge lamp such that the operating voltage of the discharge lamp is determined, wherein, during an interval in which the lower boundary value is not reached, the operating frequency of the discharge lamp is reduced by said given amount at any predetermined time interval when the determined operating voltage of the discharge lamp is below the lower boundary value, and wherein, during an interval in which the above described upper boundary value is exceeded, the operating frequency of the discharge lamp at any predetermined time interval is increased by said given amount when the operating voltage of the above described discharge lamp exceeds this upper boundary value.

11. Method of operating a high pressure discharge lamp as claimed in claim 9, wherein a power supply means the feed device is used for producing a rated operation mode and a power saving operation mode, and wherein the upper boundary value in the power saving operation mode is set lower than the upper boundary value in the rated operation mode.

12. Method of operating a high pressure discharge lamp as claimed in claim 11, wherein the feed device is operated for enabling a transition from the rated operation mode into the power saving operation mode only after the operating voltage of the discharge lamp has decreased to a given value which is lower than the lower boundary value in rated operation mode.

13. Method of operating a high pressure discharge lamp as claimed in claim 12, wherein the feed device is operated for reducing the operating voltage of the discharge lamp to a given value which is lower than the lower boundary value in the rated operation mode by fixing the operating frequency at a value which is greater than the operating frequency in the rated operation mode.

14. Method for operating a high pressure discharge lamp as claimed in claim 13, wherein the feed device is operated in a transition from the rated operation mode into the power saving mode for immediately fixing the rated wattage at a value which is smaller than the rated wattage in the rated operation mode.

15. Method of operating a high pressure discharge lamp as claimed in claim 13, wherein the feed device is operated so as to always commence operation of the discharge lamp in the rated operation mode.

* * * * *